US011346044B2

(12) United States Patent
Longshaw

(10) Patent No.: US 11,346,044 B2
(45) Date of Patent: May 31, 2022

(54) CLOTHES IRON

(71) Applicant: SUAVESY LIMITED, Dudley (GB)

(72) Inventor: Jake Longshaw, Dudley (GB)

(73) Assignee: SUAVESY LIMITED, Dudley (GB)

( * ) Notice: Subject to any disclaimer, the term of this patent is extended or adjusted under 35 U.S.C. 154(b) by 30 days.

(21) Appl. No.: 16/723,921

(22) Filed: Dec. 20, 2019

(65) Prior Publication Data

US 2020/0199808 A1 Jun. 25, 2020

(30) Foreign Application Priority Data

Dec. 21, 2018 (GB) ..... 1821071

(51) Int. Cl.

| | |
|---|---|
| ***D06F 75/38*** | (2006.01) |
| ***D06F 75/10*** | (2006.01) |
| ***D06F 75/22*** | (2006.01) |
| ***D06F 75/26*** | (2006.01) |

(52) U.S. Cl.

CPC ..... *D06F 75/38* (2013.01); *D06F 75/10* (2013.01); *D06F 75/22* (2013.01); *D06F 75/265* (2013.01)

(58) Field of Classification Search

CPC ..... D06F 75/00; D06F 75/38; D06F 75/265
See application file for complete search history.

(56) References Cited

U.S. PATENT DOCUMENTS

| | | | | |
|---|---|---|---|---|
| 997,565 | A * | 7/1911 | Larson | A47L 11/34 |
| 3,793,753 | A | 2/1974 | Engelbart | |
| 5,651,201 | A | 7/1997 | Farley | |
| 6,176,026 | B1 | 1/2001 | Leung | |
| 7,637,040 | B2 * | 12/2009 | Wu | D06F 75/30 2/159 |
| 9,549,651 | B2 * | 1/2017 | Cooper | A47L 11/34 |
| 2004/0074608 | A1 | 4/2004 | Landi et al. | |

FOREIGN PATENT DOCUMENTS

| | | | |
|---|---|---|---|
| CN | 103422334 | A | 12/2013 |
| DE | 2342813 | A | 3/1975 |
| EP | 0498056 | A1 | 8/1992 |

(Continued)

OTHER PUBLICATIONS

Search Report for Great Britain Application No. GB 1821071.6 dated Jun. 12, 2019, 2 pages.

(Continued)

*Primary Examiner* — Ismael Izaguirre
(74) *Attorney, Agent, or Firm* — Alston & Bird LLP

(57) ABSTRACT

A clothes iron including some or all of: a soleplate that narrows in a longitudinal direction and an at least partially enclosed aperture that extends in at least a transverse direction, for receiving at least a portion of a hand when in use; an interface configured to be connectable to and disconnectable from a fluid outlet external to the iron and a valve for enabling transfer of fluid from the fluid outlet to the iron via the interface while the interface is connected to the fluid outlet, and for inhibiting loss of fluid from the iron via the interface while the interface is disconnected from the fluid outlet; an aligning portion and an external aligning portion and one or more outlets to which the iron is connectable, wherein at least one of the outlets is configured to transfer fluid or electrical energy to the iron.

20 Claims, 2 Drawing Sheets

(56) References Cited

FOREIGN PATENT DOCUMENTS

| | | | |
|---|---|---|---|
| EP | 2458080 | A1 | 5/2012 |
| EP | 2705189 | A1 | 11/2012 |
| GB | 2155705 | A | 9/1985 |
| JP | H0415099 | A | 1/1992 |
| JP | H0473099 | A | 2/1992 |
| JP | 2004 081730 | A | 3/2004 |
| KR | 2010 0114291 | A | 10/2010 |
| WO | WO-2002/081810 | A1 | 10/2002 |
| WO | WO-2015/052633 | A1 | 4/2015 |

OTHER PUBLICATIONS

Search Report for GB Application No. 1821071.6 dated Jun. 4, 2021 (4 pages).
Search Report for GB Application No. 1821071.6 dated Jun. 7, 2021 (4 pages).

* cited by examiner

CLOTHES IRON

CROSS-REFERENCE TO RELATED APPLICATIONS

This application claims priority to GB Application No. 1821071.6, filed Dec. 21, 2018, the entire contents of which are incorporated herein by reference.

FIELD OF THE INVENTION

Embodiments of the present invention relate to a clothes iron. In particular, they relate to a clothes iron and a system.

BACKGROUND TO THE INVENTION

It is known for a clothes iron ('iron' herein) to comprise a handle which extends in a longitudinal direction, defining a longitudinal aperture underneath the handle which enables fingers to curl around the handle. Gripping the longitudinal handle may require ulnar deviation and can cause strain on the wrist. This design may not be ergonomic for all users, for example users with arthritis.

It is known for an iron to comprise a steam generator and to have a manually refillable reservoir. However, the iron must be refilled regularly, using a multi-step operation of filling a container with water, opening a stopper of a water reservoir of the iron, and pouring water from the container into the reservoir.

It is also known for a steam generator to be provided externally from the iron, wherein the iron is connected to the external steam generator by a steam hose. This is more convenient with regard to refilling. However, steam hoses are relatively inflexible, restricting the manoeuvrability of the iron.

BRIEF DESCRIPTION OF VARIOUS EMBODIMENTS OF THE INVENTION

According to various, but not necessarily all, embodiments of the invention there is provided a clothes iron comprising: a soleplate that narrows in a longitudinal direction; and wherein the iron defines an at least partially (optionally fully) enclosed aperture that extends in at least a transverse direction, for receiving at least a portion of a hand when in use. An advantage is a more ergonomic iron.

The width of the aperture may be dimensioned to accommodate a plurality of digits of a hand when in use. An advantage is that digits can be kept away from the soleplate.

The average height of the aperture may be dimensioned for no, or less than two centimetres of, clearance above an upper surface of a portion of a hand in the aperture when in use. The iron may comprise resiliently deformable material for contacting an upper surface of a portion of a hand in the aperture when in use. An advantage is improved ergonomics because a snug fit reduces the chance of hand slippage, and because of improved comfort.

A lower surface defining at least the aperture's lower surface may be longitudinally curved and/or slanted to follow the longitudinal arch of a portion of a hand in the aperture when in use. An advantage is improved ergonomics because flexion or extension of the fingers is not required. Even when the hand is flat it has a natural curve/dip in the palm.

The aperture may have an upper surface that is shorter than the aperture's lower surface in the longitudinal direction. An advantage is improved ergonomics because the fingertips have freedom to move and are ventilated. This facilitates the use of fingertip controls e.g. for the steam and water spray buttons.

The aperture may be inclined downwardly, towards the soleplate, in the longitudinal direction. An advantage is improved ergonomics because less wrist flexion is required than if the aperture were level with the soleplate.

The iron may comprise user fingertip controls for use by one or more fingertips of a hand in the aperture when in use. An advantage is improved ergonomics because the hand does not need to be removed from the aperture for certain controls. Optionally, other controls such as a thermostat control could be provided elsewhere.

The iron may comprise a thumb aperture. The thumb aperture may be laterally separated from the aperture and below the aperture. An advantage is that the thumb can be kept away from the soleplate, and that stability and control for directing the iron around the garment is improved.

According to various, but not necessarily all, embodiments of the invention there is provided a clothes iron comprising: an interface configured to be connectable to and disconnectable from a fluid (e.g. water or steam) outlet external to the iron; and a valve for enabling transfer of fluid from the fluid outlet to the iron via the interface while the interface is connected to the fluid outlet, and for inhibiting loss of fluid from the iron via the interface while the interface is disconnected from the fluid outlet. An advantage is a more ergonomic and easier to use iron, having the advantages of access to a voluminous external reservoir but without the stiff hose.

The valve may be configured to open automatically, or to be openable via a user control, to enable the transfer of fluid to the iron, when the interface is connected to the fluid outlet, and the valve may be configured to not open automatically, or to not be openable via the user control, when the interface is not connected to the fluid outlet. An advantage is an easier to use iron because fewer user inputs are required and/or the valve cannot be opened accidentally.

The iron may comprise locking means (e.g. lock) for engaging the interface with the fluid outlet when the interface is connected to the fluid outlet. An advantage is an easier to use iron because the locking means confirms when a fluid-tight seal has been formed.

The locking means may be push-to-connect and the valve may be push-to-open. An advantage is an easier to use iron because refill requires no user inputs other than moving the iron into a required position.

The iron may comprise: an at least partially enclosed aperture for receiving at least a portion of a hand when in use; and means (e.g. disconnector) for enabling disconnection of the locking means without requiring removal of the user's hand from the aperture. An advantage is an easier to use iron.

The iron may comprise an aligning portion for engaging with an external aligning portion to align the interface with the fluid outlet as the iron is moved towards the fluid outlet. An advantage is an easier to use iron because less precise movements are required for recharge. This may be useful for users with impaired control over hand motions.

The aligning portion may comprise one of a recess or protrusion and the external aligning portion may comprise the other of a recess or protrusion. An advantage is an easier to use iron because even less precise movements are required for recharge, as the iron is guided along a channel.

The iron may comprise an electrical connector arranged to connect to an electrical outlet external to the iron when the iron is moved to connect the interface to the fluid outlet. An advantage is an easer to use iron because it is cordless, i.e. steam generation could occur only when docked.

The electrical connector may be a push-to-connect electrical connector. An advantage is an easier to use iron because a single user action commences both fluid recharge and electrical energy transfer.

According to various, but not necessarily all, embodiments of the invention there is provided a system comprising the clothes iron and the fluid outlet, and means (e.g. pump) for applying a pressure gradient to transfer fluid through the fluid outlet to the interface of the iron. An advantage is an easier to use iron, because fewer user inputs are required for fluid recharge.

The system may comprise a docking station for docking the iron, wherein the docking station comprises the fluid outlet. The system may comprise a reservoir associated with the fluid outlet. An advantage is an easier to use iron, because the iron can be kept in a docking position when not in use, and heating/fluid recharge may commence immediately upon warmup.

According to various, but not necessarily all, embodiments of the invention there is provided a system comprising: a clothes iron comprising an aligning portion; one or more outlets to which the iron is connectable, wherein at least one of the outlets is configured to transfer fluid (e.g. water or steam) or electrical energy to the iron; and an external aligning portion external to the iron, wherein the aligning portion and the external aligning portion are configured to engage as the iron is moved towards the one or more outlets, to align the iron with the one or more outlets.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
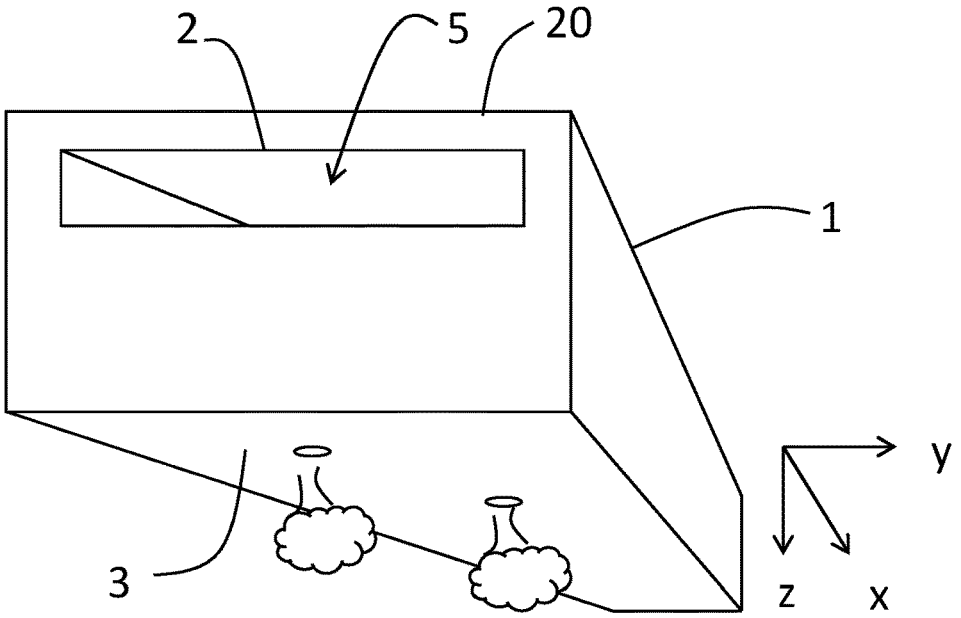
FIG. 1 illustrates an example of an iron with a transverse aperture.
Figure 5:
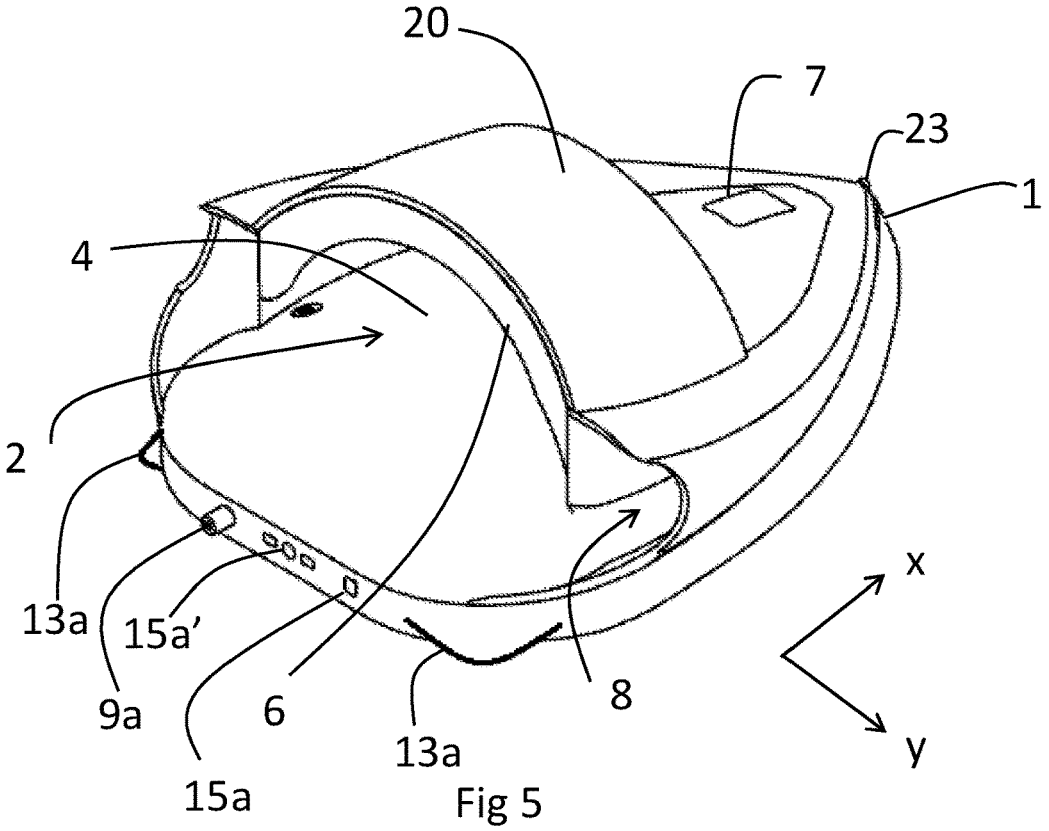
FIG. 5 illustrates an example of an iron.

FIG. 1 schematically illustrates an iron 1 in a rear-angled and below perspective view. FIG. 5 schematically illustrates another more specific iron in a rear-angled and above perspective view.

The iron 1 comprises a soleplate 3. Typical soleplate materials include ceramic, stainless steel, or titanium. The soleplate 3 may comprise a plurality of steam apertures.

The soleplate 3 may narrow in a longitudinal direction (x-axis) towards the front of the iron 1, as shown in FIG. 1. In a specific example, the soleplate 3 may have a u-shape, v-shape or the like.

The soleplate 3 may cover the whole area or a partial area of the underside of the iron 1.

The iron 1 of FIG. 1 has no handle shaped for gripping with a fist. Instead, the iron 1 defines a fully enclosed aperture 2 for receiving at least a portion of a hand when in use. The upper surface 5 of the aperture 2 may be provided by a cover portion 20 extending between left and right lateral sides of the iron 1. In alternative examples, the aperture 2 may be partially enclosed, for example, part of the upper surface 5 may be discontinuous and open along the x-axis.

The aperture 2 extends in a transverse direction (y-axis, between the left and right lateral sides) and not in the x-axis. In alternative examples, the aperture 2 may additionally extend in the x-axis.

Because the aperture 2 extends in the transverse direction, the hand should be inserted into the aperture 2 from the rear of the iron 1.

Although the illustrated aperture 2 is rectangular, the aperture 2 could have a different shape in other examples. In a specific example, the aperture 2 could have an arched upper surface 5 as shown in FIG. 5.

Figure 2:
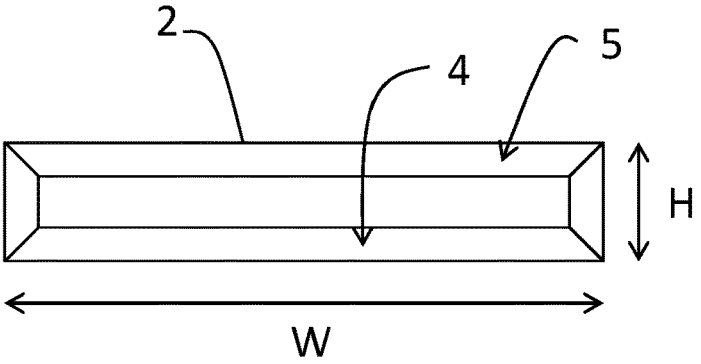
FIG. 2 illustrates an example of the transverse aperture.

FIG. 2 schematically illustrates the aperture 2 in a rear perspective view, looking through the aperture 2 (approximately along the x-axis). The aperture 2 has a pre-determined width W and height H to fit a user's hand.

The width W of the aperture 2 in the y-axis may be dimensioned to accommodate a plurality of digits of the hand when in use. For example, the aperture 2 may be dimensioned to accommodate four fingers alongside each other without squeezing the sides of the fingers together. In a specific example, the aperture's width is from the range approximately 7 cm to approximately 15 cm. In alternative examples, the aperture 2 may be narrower, for two or three fingers, or wider to accommodate a thumb.

The average height H of the aperture 2, defined as the average z-axis separation of the upper surface 5 of the aperture 2 from the lower surface 4 of the aperture 2, may be dimensioned for no clearance above the upper surface of the portion of the hand which is within the aperture 2. This ensures a snug fit. In other examples, there may be less than 2 cm of clearance on average. In a specific example, the average height is from the range approximately 2 cm to approximately 5 cm. In some examples, the height may vary with lateral position as shown in FIG. 5.

A palm-down hand in a resting position has a longitudinal arch such that the fingers are pointing downwards relative to the plane of the palm. Therefore, a forward portion of the surface defining at least the lower surface 4 of the aperture 2 may curve and/or slant downwards (z-axis, towards soleplate) towards the front of the iron 1, wherein the fingers will overlie the forward portion. A rearward portion of the surface may curve and/or slant upwards (or less downwardly) than the forward portion, wherein at least a portion of the palm will overlie the rearward portion. Alternatively, the lower surface 4 of the aperture 2 may be parallel to the x-y plane.

The upper surface 5 of the aperture 2 may additionally slant downwards towards the front of the iron 1. Therefore, the aperture 2 may be inclined downwardly towards the front of the iron 1, i.e. getting closer to the soleplate 3 towards the front of the iron 1.

The aperture 2 may be shorter than the length of a human hand. The aperture 2 may therefore be a through hole rather than a blind hole. For example, the upper surface 5 of the aperture 2 may be shorter in the x-direction than the surface that comprises the lower surface 4 of the aperture 2, as shown in FIG. 5. The ends of the user's fingers may therefore be able to protrude beyond the end of the aperture 2.

This enables freedom for the fingers to flex to operate optional fingertip controls. The fingertip control(s) may be located towards the front of the forward portion of the lower surface 4, in the non-enclosed region forward of the upper surface 5. A single fingertip control 7 is illustrated in FIG. 5, reachable by a finger other than a thumb, however more could be provided in other examples. Example fingertip controls include temperature, spray control, rate of steam release, or a combination thereof. In other examples, at least some of the control(s) could be provided elsewhere on the iron 1.

The average x-axis length of the cover portion 20 defining the upper surface 5 of the aperture 2 may be from the range approximately 4 cm to approximately 20 cm. If the user's fingers are able to protrude, the length may be from the range approximately 4 cm to approximately 10 cm. The cover portion 20 may be formed from a rigid polymeric material such as plastic. In some examples, the cover portion 20 may be shorter than 4 cm. In some examples, the cover portion 20 may be shorter than 4 cm and may be comprised of a resiliently flexible strap or band.

Resiliently deformable material may be provided at the upper surface 5 of the aperture 2, for contacting the upper surface of the portion of the hand which is within the aperture 2. The material may be resiliently deformable compared to the material defining the lower surface 4, which may be a rigid polymeric material or another relatively rigid material. Additionally or alternatively, resiliently deformable material can be provided at the lower surface 4 of the aperture 2. The resiliently deformable material may comprise memory gel, memory foam, or another elastomeric material.

The cover portion 20 may comprise rigid polymeric material distal to the user's hand, and the resiliently deformable material proximal to the user's hand. The rigid material inhibits flexing of the cover portion 20. Alternatively, the cover portion 20 may be resiliently flexible. Optionally, the cover portion 20 may consist of resiliently deformable material.

The iron 1 may further comprise a thumb aperture 8. One thumb aperture 8 is illustrated in FIG. 5. If the iron 1 is ambidextrous, thumb apertures may be provided to both lateral sides of the main aperture 2. A fingertip control (thumbtip control) may be positioned to be usable by a thumb in the thumb aperture 8.

The opening of the thumb aperture 8 may extend in at least the transverse (y) direction as per the main aperture 2. The transverse thumb aperture 8 opening may be open to thumb insertion into the thumb aperture 8 from the rear of the iron 1.

Since the thumb of a resting palm-down hand is below the plane of the fingers of the hand, and laterally separated from the fingers, the thumb aperture 8 may be laterally separated from the aperture 2 and/or may be slightly below the aperture 2. For example, an upper surface of the thumb aperture 8 may be below the upper surface 5 of the aperture 2.

Since a resting thumb tends to curl inwards towards the palm, the thumb aperture 8 may curve inwards. The inwards curvature may be approximately coaxial with the narrowing of the soleplate 3 in the x-direction.

The thumb aperture 8 may be fully enclosed or partially enclosed.

Figure 3:
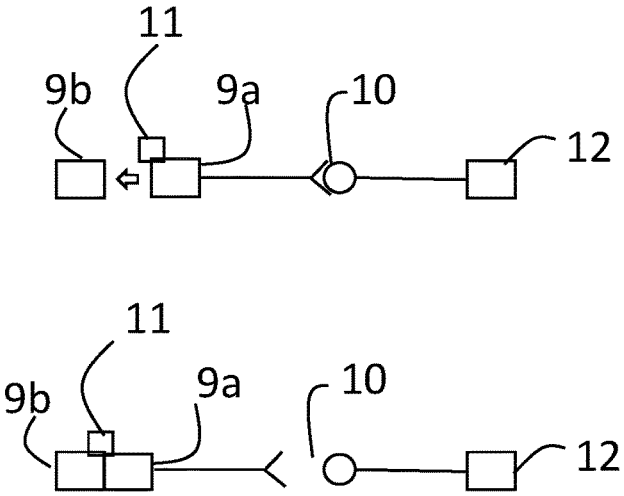
FIG. 3 illustrates an example of means for recharging an iron with fluid.

FIG. 3 schematically illustrates how fluid recharge (water or steam) of an iron 1 could work according to various, but not necessarily all, embodiments of the invention. The iron 1 may be as shown in FIGS. 1 and 5, or a different iron 1.

The iron 1 comprises water storage means 12 (e.g. iron reservoir or steam chamber). The iron 1 comprises an interface 9*a* configured to be connectable to and disconnectable from a fluid outlet 9*b* external to the iron 1. With reference to FIG. 5, the interface 9*a* may be located at the rear of the iron 1, however the interface 9*a* may be located on the underside or elsewhere in other examples.

Figure 6:
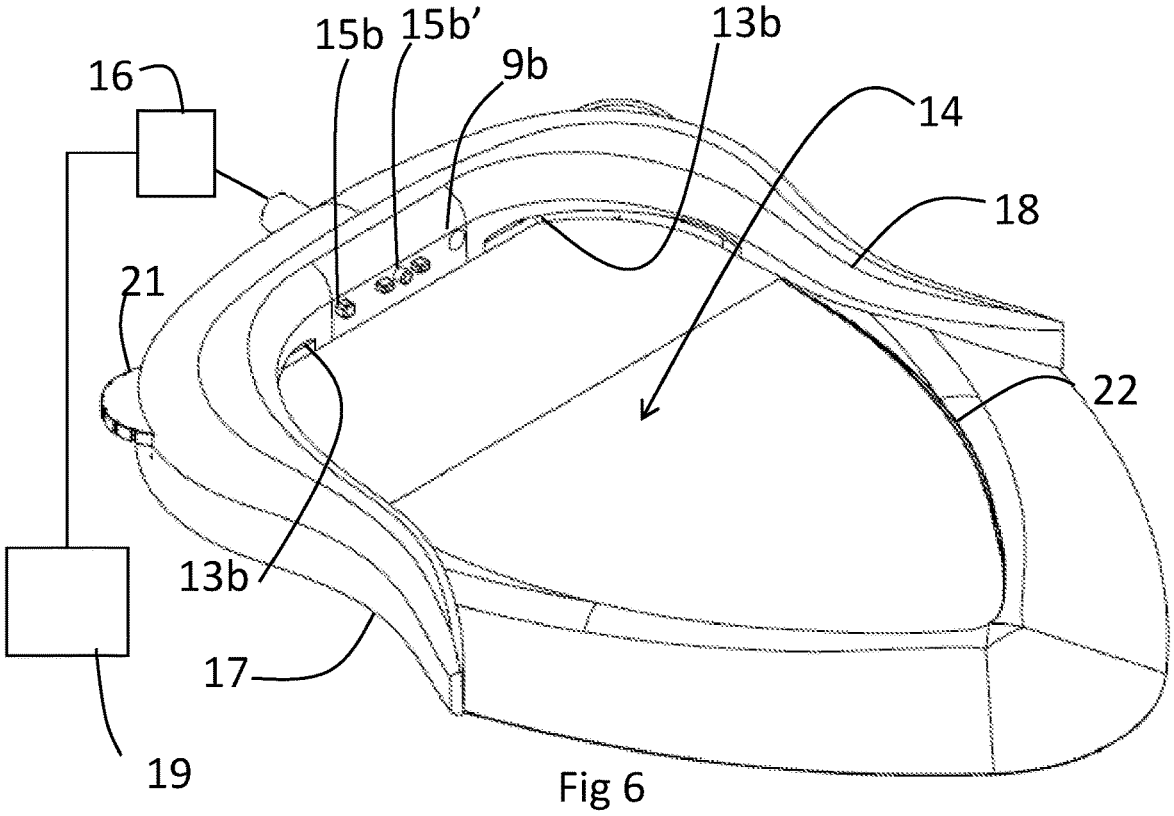
FIG. 6 illustrates an example of a docking station.

The fluid outlet 9*b* is also illustrated in FIG. 3. With reference to FIG. 6, the fluid outlet 9*b* may be in fluid communication with a reservoir 19 external to the iron 1. The reservoir 19 may have a large capacity of a 500 ml or more, for convenience.

The water storage means 12 may be only refillable via the interface 9*a*, and not via any manual refill port. In other examples, a stopper-controlled manual refill port could be provided in addition.

The water storage means 12 may have a relatively small capacity to enable the iron 1 to be compact. Its fluid capacity may be optionally no greater than 100 ml, and in some examples no greater than 50 ml.

FIG. 3 also illustrates a valve 10 for enabling transfer of fluid from the fluid outlet 9*b* to the iron 1 via the interface 9*a* while the interface 9*a* is connected to the fluid outlet 9*b*. The valve 10 is illustrated between the interface 9*a* and the water storage means 12. In other examples, the valve 10 may be within the interface 9*a*. Although the illustrated valve 10 appears circular or spherical, the valve 10 could take any other appropriate form depending on implementation. The valve 10 could be a one-way check valve for only allowing fluid to flow in one direction towards the iron, and not in the opposite direction away from the iron. Optionally, the valve 10 could allow fluid passage in both directions.

The valve 10 is closed when the iron 1 is not recharging, to inhibit loss of fluid from the iron 1 via the interface 9*a* while the interface 9*a* is disconnected from the fluid outlet 9*b*. To achieve this, the valve 10 could be a simple check valve. However, the valve 10 could be a different type such as a multi input and/or output directional control valve, a butterfly valve, etc.

The valve 10 may be configured to open automatically, to enable the transfer of fluid to the iron 1, when the interface 9*a* is pushed into the fluid outlet 9*b* to connect to the fluid outlet 9*b*. The valve 10 may be push-to-open. The valve 10 may stay open while the interface 9*a* is connected to the fluid outlet 9*b*, not requiring continued user actuation to stay open.

In an example, the valve 10 may be close to or within the interface 9*a*. The valve 10 may be passively opened by a mechanism or projection associated with connecting the interface 9*a* with the fluid outlet 9*b*. For example, the fluid outlet 9*b* may comprise a projection that projects inside the interface 9*a* and pushes the valve 10 open. The valve 10 does not open when the interface 9*a* is not connected to the fluid outlet 9*b*.

In another example, the valve 10 may be actively automatically opened by an actuator. The actuator could be actuated in dependence on an input from a sensor (e.g. magnetic, light or any other type) configured to detect connection of the interface 9*a* with the fluid outlet 9*b*. The valve 10 does not open when the connection is not detected.

In other examples, the valve 10 may be openable manually via a user control, when the interface 9*a* is connected to the fluid outlet 9*b*. The user control could be a button, for example. Optionally, the valve 10 cannot be opened when the interface 9*a* is not connected to the fluid outlet 9*b*. For example, a mechanism may be provided that locks the user control when the interface 9*a* is not connected to the fluid outlet 9*b*, and unlocks the user control when the interface 9*a* is connected to the fluid outlet 9*b*.

Various features may be provided to improve the seal between the interface 9*a* and the fluid outlet 9*b*. An O-ring or other known seals (not shown) may be provided to enable a water-tight seal.

Locking means 11 may be provided for engaging the interface 9*a* with the fluid outlet 9*b* when the interface 9*a* is connected to the fluid outlet 9*b*. The locking means 11 may inhibit breaking of the connection of the interface 9*a* from the fluid outlet 9*b* before disengagement of the locking means 11. Part of the locking means 11 may be provided on the iron 1 and the other part may be external to the iron 1, located at or near the fluid outlet 9*b*.

The locking means 11 may comprise one or more of a sliding collar, a hook, a cam, a screw thread, a collet, or various other components. Advantageously, the locking means 11 may be push-to-connect (e.g. sliding collar-based), with no further user action required to engage the locking means 11. The locking means 11 and valve 10 may together define a quick release fluid coupling.

In some examples, the valve 10 and locking means 11 may interact, such that the locking means 11 opens the valve 10 when engaging the interface 9*a* with the fluid outlet 9*b*. A single movement of the iron could engage the locking means 11 and open the valve 10, such as a movement of the iron into a docking position on a docking station 17 such as the one shown in FIG. 6.

The locking means 11 could be disengaged automatically or manually. The locking means 11 could be configured to disengage automatically upon lifting the front or rear of the iron 1, therefore tilting a mechanism that disengages the locking means 11. Alternatively or additionally, the locking means 11 could be configured to disengage automatically upon pushing the iron 1 closer to the fluid outlet 9*b* to actuate a disengaging mechanism, before the user pulls the iron 1 away from the fluid outlet 9*b*. The locking means 11 could be configured to disengage manually by directly or indirectly operating the sliding collar, hook, cam, screw, thread or the like. Indirect operation may comprise use of a fingertip control of an iron 1 as shown in FIG. 1 or 5, so that the hand does not have to be removed from the aperture 2.

FIG. 3 shows two illustrations. In the upper illustration, the interface 9*a* is not connected to the fluid outlet 9*b*, the valve 10 is closed, and the locking means 11 is disengaged. In the lower illustration, the interface 9*a* is connected to the fluid outlet 9*b*, the valve 10 is open, and the locking means 11 is engaged.

Another feature which could be provided is means 16 for applying a pressure gradient to transfer fluid through the fluid outlet 9*b* to the interface 9*a*, when the valve 10 is open and the interface 9*a* is connected to the fluid outlet 9*b*. For example, a pump 16 could be provided between the reservoir 19 and the fluid outlet 9*b*, as shown in FIG. 6. The pump 16 could raise the fluid pressure between the pump 16 and the fluid outlet 9*b*, to cause fluid to flow into the iron 1.

The iron 1 may further comprise one or more electrical connectors 15*a*, 15*a*'. The one or more electrical connectors 15*a*, 15*a'* may comprise: an electrical connector for powering an onboard steam generating heating element of the iron 1; an electrical connector for recharging a battery of the iron 1 (if battery-powered); an electrical connector for powering other circuitry of the iron 1; an electrical connector for coupling an output of a sensor of the iron 1 to control and/or measurement circuitry external from the iron; or a combination thereof. The iron 1 may be wireless, meaning that the iron 1 may be free of any wires (electrical wire and fluid hose).

One or more of the above electrical connector functions could be combined and provided by a single electrical connector 15*a*, or they could be provided by separate electrical connectors 15*a*, 15*a*'. The electrical connection provided by the electrical connector 15*a*, 15*a'* may be galvanic, but other electrical connection means could be provided in other examples.

The electrical connector 15*a* may arranged to connect to an electrical outlet 15*b*, 15*b'* external to the iron 1 when the iron 1 is moved to connect the interface 9*a* to the fluid outlet 9*b*. Therefore, the iron 1 may be docked to simultaneously or sequentially recharge its fluid and power electrical components. FIG. 5 illustrates an example electrical connector 15*a* and FIG. 6 illustrates example external electrical outlets 15*b*, 15*b*'. The illustrated electrical connectors 15*a*, 15*a'* are at the rear of the iron 1, proximal to the interface 9*a*, but could be provided elsewhere in other examples. The electrical connectors 15*a*, 15*a'* could be push-to-connect and/or pull-to-disconnect.

Figure 4:
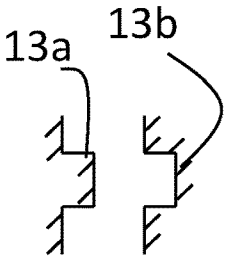
FIG. 4 illustrates an example of aligning portions for aligning an iron.

FIG. 4 schematically illustrates aligning portions 13*a*, 13*b* for aligning an iron 1 with an outlet according to various, but not necessarily all, embodiments of the invention. For example, the aligning portions 13*a*, 13*b* may align the interface 9*a* with the fluid outlet 9*b* and/or may align the electrical connector 15*a* with the electrical outlet 15*b*. The iron 1 may be as shown in FIGS. 1 and 5, or a different iron 1.

The aligning portions comprise a recess 13*b* (female) and a protrusion 13*a* (male, flange-like). One or more protrusions 13*a* could fit into one or more recesses 13*b*, to inhibit movement in at least one direction while allowing movement in at least one other direction. The recess 13*b* may define a channel for guiding the iron 1 along a path towards a docking position 14 of the iron 1. The alignment may be lateral alignment. Optionally, the alignment may be vertical and/or longitudinal and/or lateral.

In FIGS. 5 and 6, the iron 1 comprises protrusions 13*a* and the external aligning portions are recesses 13*b*. The protrusion(s) 13*a* may be located above a plane of the soleplate 3 of the iron 1. In other examples, the iron 1 may comprise the recesses 13*b* and the protrusions 13*a* may be external.

The illustrated aligning portions 13*a* or 13*b* of the iron 1 are provided at a rear-side quarters of the iron 1 because the iron 1 is moved backwards into its docking position 14. The protrusion 13*a* may be a lateral protrusion. In other examples, the aligning portions 13*a* or 13*b* of the iron 1 may be provided on the underside of the iron 1 and above the soleplate 3, or at other positions.

The aligning portions 13*a*, 13*b* may force the iron 1 to be slid into the docking position 14 in a generally horizontal plate (x-y plane). In some examples, the iron 1 could be lifted and/or slid out of the docking position 14. The iron could be releasable by lifting the iron front first.

Retaining means 22 such as a ridge may be provided at the front of the docking position 14, to create an interference between a portion of the front of the iron 1, such as the front of the soleplate 3, and the retaining means 22. This interference restrains the iron 1 against forward movement caused when a hand is inserted forward into the aperture 2. This enables the hand to be removed and re-inserted during recharge without moving the iron and disturbing the fluid and/or electrical coupling. To remove the iron 1 from the docking position 14 easily, the retaining means 22 may be configured to enable the portion of the front of the iron 1 to be lifted to remove the interference, e.g. by lifting the front of the soleplate 3 above the ridge.

Although the aligning portions 13*a*, 13*b* illustrated in FIG. 4 are angular, they could be curved in other examples such as the aligning portions 13*a* of FIG. 5.

FIG. 6 illustrates an example docking station 17 which may comprise one or more of the above-described components that are external to the iron 1. The illustrated docking station 17 comprises the fluid outlet 9*b*, the electrical outlet 15*b*, external aligning portions 13*b*, retaining means 22, and may further optionally comprise guide walls 18.

The guide walls 18 may be provided to the left and right sides of the iron and may converge laterally towards each other towards the rear of the docking position 14, defining a narrowing space therebetween as the iron is moved rearwardly into the docking position 14. The converging guide walls 18 enable a coarse lateral alignment of the iron 1, and the aligning portions 13*a*, 13*b* enable a fine alignment. In other examples, the alignment may be performed by just the guide walls 18 and no aligning portions, or just the aligning portions 13*a*, 13*b* and no guide walls.

The docking station 17 may comprise the reservoir 19 and/or pump 16, or they could be external to the docking station 17 and coupled to the docking station 17. A system may comprise the iron 1 and one or more of: the docking station 17; the pump; or the reservoir 19.

An example of how a wireless version of the iron 1 might be operated will now be described, according to various, but not necessarily all examples. The iron 1 may comprise a heat sensor (not shown) for sensing a parameter associated with current temperature, e.g. of the soleplate 3. The heat sensor could comprise a thermostat (e.g. bimetallic strip), a thermocouple, a semiconductor sensor, or could take any other appropriate form.

The parameter from the heat sensor may be output via a wired or wireless coupling to an external controller and heating circuit (not shown) for controlling soleplate temperature. The output may occur only when the iron 1 is docked (e.g. via an electrical connector 15*a*) or may be additionally capable of occurring while the iron is undocked (e.g. other coupling).

The controller for the heating circuit may also be configured to receive an input indicative of a required temperature. The input may come from a user control 21 (e.g. dial) off-board or on-board the iron 1.

The controller for the heating circuit may be configured to determine, by comparing the current temperature and the required temperature, whether additional heating is required. If additional heating is required, electrical energy can be provided to the iron 1, for example when the iron 1 is docked, to heat the sole plate/charge the battery (if depleted) for the on-board heater, etc. The controller may be mechanical, electrical, or electromechanical.

An indicator 23, such as an LED indicator, may be provided on the iron 1 for causing the indicator to indicate to a user that the iron 1 should be docked to allow electrical current to be provided to heat the soleplate 3. The indicator may be on-board or off-board the iron 1. The indicator may be controlled by a controller that may determine whether to cause the indication to the user in dependence on the output from the sensor, or in dependence on a timer. Using the heat sensor would be more accurate than using the timer, and therefore more efficient.

In other examples, the iron 1 may be a wired iron with a continuous electrical supply, and/or heat control may be achieved via a conventional thermostat.

Referring to FIG. 5, a hand in a resting position has a transverse arch. In some, but not necessarily all examples the lower surface 4 of the aperture 2 is transversely curved. The lower surface 4 may be transversely curved as well as longitudinally curved and/or slanted. The lower surface 4 may be transversely curved in the y-axis transverse direction, to generally follow the contours of a palm-down hand. The transverse curvature of the lower surface 4 may be configured to follow the curvature of a transverse arch or arches of the palm-down hand, to improve ergonomics. The transverse curvature of the lower surface 4 may differ at different longitudinal positions along the lower surface 4, to follow the different curvatures of the transverse arches of a hand.

Although embodiments of the present invention have been described in the preceding paragraphs with reference to various examples, it should be appreciated that modifications to the examples given can be made without departing from the scope of the invention as claimed. The concepts described in relation to FIGS. 3 and 4 can be applied to irons having none or some of the features of the irons of FIGS. 1 and 5.

Several dimensions associated with the aperture 2 are defined relative to a hand, as defined herein. A reference size for a hand is not specified but is what the skilled person would easily choose when designing a product for mass market adult use. The aperture 2 described herein is not solely for particularly large or particularly small hands. In one non-limiting implementation, various dimensions described herein may be suitable to accommodate a $5^{th}$ percentile adult hand from a random population (i.e. 95% of the population has smaller hands), or even a $1^{st}$ percentile adult hand.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

That which is claimed is:

1. A clothes iron comprising:

a soleplate that narrows in a longitudinal direction;

wherein the clothes iron defines an at least partially enclosed aperture that extends in at least a transverse direction, to receive at least a portion of a hand when in use; and wherein the clothes iron comprises a cover portion, wherein the cover portion comprises a rigid material to inhibit flexing of the cover portion.

2. The clothes iron of claim 1, wherein a width of the aperture is dimensioned to accommodate a plurality of digits of the hand when in use, and wherein an average height of the aperture is dimensioned for no, or less than two centimeters of, clearance above an upper surface of the portion of the hand in the aperture when in use.

3. The clothes iron of claim 1, wherein the aperture has an upper surface that is shorter than a lower surface of the aperture in the longitudinal direction.

4. The clothes iron of claim 1, comprising a resiliently deformable material to contact an upper surface of the portion of the hand in the aperture when in use.

5. The clothes iron of claim 1, wherein the aperture is fully enclosed.

6. The clothes iron of claim 1, wherein the aperture is inclined downwardly, towards the soleplate, in the longitudinal direction.

7. The clothes iron of claim 1, comprising a pair of thumb apertures located to opposing sides of the aperture.

8. The clothes iron of claim 1, comprising:

an interface configured to be connectable to and disconnectable from a fluid outlet external to the clothes iron; and a valve configured to enable transfer of fluid from the fluid outlet to the clothes iron via the interface while the interface is connected to the fluid outlet, and configured to inhibit loss of fluid from the clothes iron via the interface while the interface is disconnected from the fluid outlet.

9. The clothes iron of claim 8, wherein the valve is configured to open automatically, or to be openable via a user control, to enable the transfer of fluid to the clothes iron, when the interface is connected to the fluid outlet, and wherein the valve is configured to not open automatically, or to not be openable via the user control, when the interface is not connected to the fluid outlet.

10. The clothes iron of claim 8, comprising a lock configured to engage the interface with the fluid outlet when the interface is connected to the fluid outlet.

11. The clothes iron of claim 8, comprising: a disengaging mechanism configured to enable disconnection of a locking means without requiring removal of the user's hand from the aperture.

12. The clothes iron of claim 8, comprising an electrical connector arranged to connect to an electrical outlet external to the clothes iron when the clothes iron is moved to connect the interface to the fluid outlet.

13. A system comprising the clothes iron and the fluid outlet of claim 8, and a pump configured to apply a pressure gradient to transfer fluid through the fluid outlet to the interface of the clothes iron.

14. The system of claim 13, comprising a docking station to which the clothes iron is dockable, wherein the docking station comprises the fluid outlet.

15. The system of claim 13, comprising a reservoir associated with the fluid outlet.

16. A system comprising:

the clothes iron as claimed in claim 1, the clothes iron comprising an aligning portion;

one or more outlets to which the clothes iron is connectable, wherein at least one of the outlets is configured to transfer fluid or electrical energy to the clothes iron; and an external aligning portion external to the clothes iron, wherein the aligning portion and the external aligning portion are configured to engage as the clothes iron is moved towards the one or more outlets, to align the clothes iron with the one or more outlets.

17. The clothes iron of claim 1, comprising at least one user fingertip control located longitudinally forward of the aperture, to be controlled by one or more fingertips of the hand when the hand is in the aperture.

18. A clothes iron comprising:

a soleplate that narrows in a longitudinal direction;

wherein the clothes iron defines an at least partially enclosed aperture that extends in at least a transverse direction, to receive at least a portion of a hand when in use, and wherein a lower surface defining at least the aperture's lower surface is:

longitudinally curved, longitudinally slanted, or a combination thereof; and transversely curved.

19. A clothes iron comprising:

a soleplate that narrows in a longitudinal direction;

wherein the clothes iron defines an at least partially enclosed aperture that extends in at least a transverse direction, to receive at least a portion of a hand when in use, and wherein the clothes iron further comprises:

an interface configured to be connectable to and disconnectable from a fluid outlet external to the clothes iron;

a valve configured to enable transfer of fluid from the fluid outlet to the clothes iron via the interface while the interface is connected to the fluid outlet, and configured to inhibit loss of fluid from the clothes iron via the interface while the interface is disconnected from the fluid outlet; and a lock configured to engage the interface with the fluid outlet when the interface is connected to the fluid outlet, wherein the lock is push-to-connect and the valve is push-to-open.

20. A clothes iron comprising:

a soleplate that narrows in a longitudinal direction, wherein the clothes iron defines an at least partially enclosed aperture that extends in at least a transverse direction, to receive at least a portion of a hand when in use, and wherein the clothes iron further comprises resiliently deformable material to contact the portion of the hand in the aperture when in use, and wherein the resiliently deformable material comprises memory gel or memory foam.

* * * * *